US007588082B2

(12) United States Patent
Lasater

(10) Patent No.: US 7,588,082 B2
(45) Date of Patent: Sep. 15, 2009

(54) DOWNHOLE TOOL POSITION SENSING SYSTEM

(75) Inventor: Jeffrey B. Lasater, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 141 days.

(21) Appl. No.: 11/459,271

(22) Filed: Jul. 21, 2006

(65) Prior Publication Data

US 2007/0017705 A1 Jan. 25, 2007

Related U.S. Application Data

(60) Provisional application No. 60/701,688, filed on Jul. 22, 2005.

(51) Int. Cl.
*E21B 47/00* (2006.01)

(52) U.S. Cl. ..... 166/255.1; 166/255.2; 175/40; 175/45

(58) Field of Classification Search ..... 175/40, 175/45, 73, 74; 166/255.1, 250.01, 255.2
See application file for complete search history.

(56) References Cited

U.S. PATENT DOCUMENTS

| | | | | |
|---|---|---|---|---|
| 4,662,458 | A * | 5/1987 | Ho | 175/27 |
| 5,419,405 | A * | 5/1995 | Patton | 175/27 |
| 5,439,064 | A * | 8/1995 | Patton | 175/24 |
| 5,448,227 | A | 9/1995 | Orban et al. | |
| 6,076,268 | A * | 6/2000 | Fuhr | 33/304 |
| 6,234,259 | B1 * | 5/2001 | Kuckes et al. | 175/73 |
| 6,257,355 | B1 | 7/2001 | Baker | |
| 6,948,572 | B2 * | 9/2005 | Hay et al. | 175/61 |
| 2002/0185315 | A1 * | 12/2002 | McLoughlin et al. | 175/76 |
| 2002/0195278 | A1 * | 12/2002 | Vandenberg et al. | 175/73 |
| 2003/0034178 | A1 * | 2/2003 | Cargill et al. | 175/73 |
| 2004/0112640 | A1 * | 6/2004 | Hay et al. | 175/26 |
| 2004/0231893 | A1 * | 11/2004 | Kent | 175/74 |
| 2005/0269082 | A1 * | 12/2005 | Baron et al. | 166/255.2 |
| 2006/0185900 | A1 * | 8/2006 | Jones et al. | 175/26 |
| 2007/0107937 | A1 * | 5/2007 | Sugiura | 175/45 |
| 2008/0035376 | A1 * | 2/2008 | Freyer | 175/45 |

* cited by examiner

*Primary Examiner*—David J Bagnell
*Assistant Examiner*—Cathleen R Hutchins
(74) *Attorney, Agent, or Firm*—Conley Rose, P.C.

(57) ABSTRACT

A downhole tool includes a mandrel, an inner sleeve, and an outer housing. The inner sleeve being rotatable relative to the outer housing and the mandrel being rotatable relative to the inner sleeve and the outer housings. The outer surface of the inner sleeve includes more than one selected position organized in at least one set. At least two of the selected positions include magnets. The downhole tool also includes at least one magnetic sensor to sense at least one of the amplitude and polarity of the magnetic field for the selected positions and to transmit a signal indicative of the sensed magnetic field. The downhole tool also includes an electronics system to process the sensor signal to determine a magnet reference position of the inner sleeve relative to the outer housing.

24 Claims, 7 Drawing Sheets

DOWNHOLE TOOL POSITION SENSING SYSTEM

CROSS-REFERENCE TO RELATED APPLICATIONS

This application claims the benefit under 35 U.S.C. 119(e) of U.S. Provisional Application No. 60/701,688, entitled "Toolface Position Sensor and Correction System", filed Jul. 22, 2005.

STATEMENT REGARDING FEDERALLY SPONSORED RESEARCH OR DEVELOPMENT

Not Applicable.

BACKGROUND

Drilling a well involves using a drill bit inserted into the ground on a drill string. Also included on the drill string may be various tools for, performing tasks associated with drilling the wellbore. For example, when drilling a well, a drill operator often wishes to deviate a wellbore or control its direction to a given point within a producing formation. This operation is known as directional drilling. One example of this is for a water injection well in an oil field that is generally positioned at the edges of the field and at a low point in that field (or formation).

One type of drilling tool for drilling a deviated wellbore is a rotary steerable tool (RST) that controls the direction of a well bore. The RST tool uses an actuator, to manipulate the relative position of an inner sleeve with respect to an outer housing to orient the drill string in the desired drilling direction. The RST tool further includes a "brake" to lock the position of the inner sleeve relative to the outer housing once the desired relative position is obtained. A processor instructs the actuator to move the position of the direction of application of the force on the mandrel. The processor may also be used for determining when the direction of the force applied by the direction controller should be moved. The actuator in the outer housing may move the inner sleeve using a drive train with a very high gear ratio, for example 10,000:1. To determine the relative orientation of the inner sleeve to the outer housing, the RST tool uses the rotation of the motor and a known initial orientation of the inner sleeve to the outer housing to determine a "motor" reference position. As the motor turns, it energizes reference poles. The RST tool monitors and processes the energization of the reference poles, or "clicks", to resolve the magnitude and direction the motor has turned. The RST tool uses the motor travel information, in addition to the known gear ratio between the inner sleeve and the actuator, to determine the position of the inner sleeve relative to the outer housing at any given time.

One issue that may occur is the ability of the RST tool to process the "clicks" of the motor reference poles. If an excessive external force is applied to the outer housing, the brake is designed to slip, which results in the motor and its drive train turning in that direction. Because the gearing ratio back to the motor may be over 10,000 to 1, the speed at which the end of the motor is spinning may create "clicks" faster than the processor may be able to process. Thus, the processor may miscount the number of "clicks", resulting in the calculated versus actual position on the inner sleeve relative to the outer housing being out of sync.

Other types of downhole tools may also be included on the drill string. Additionally, other types of downhole tools may be comprised of a mandrel, an inner sleeve, and an outer housing. Still further, other downhole tools may include the use of a magnet on the inner sleeve as a "home position" and a magnetic sensor on the outer housing that detects the magnetic field of the magnet as it rotates relative to the sensor. However, such systems may only determine one position of the inner sleeve relative to the outer housing. Any positions other than the "home position" may not be detected. Additionally, a problem might arise if the magnetic sensor does not detect the magnet and the magnet never rotates past the sensor.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
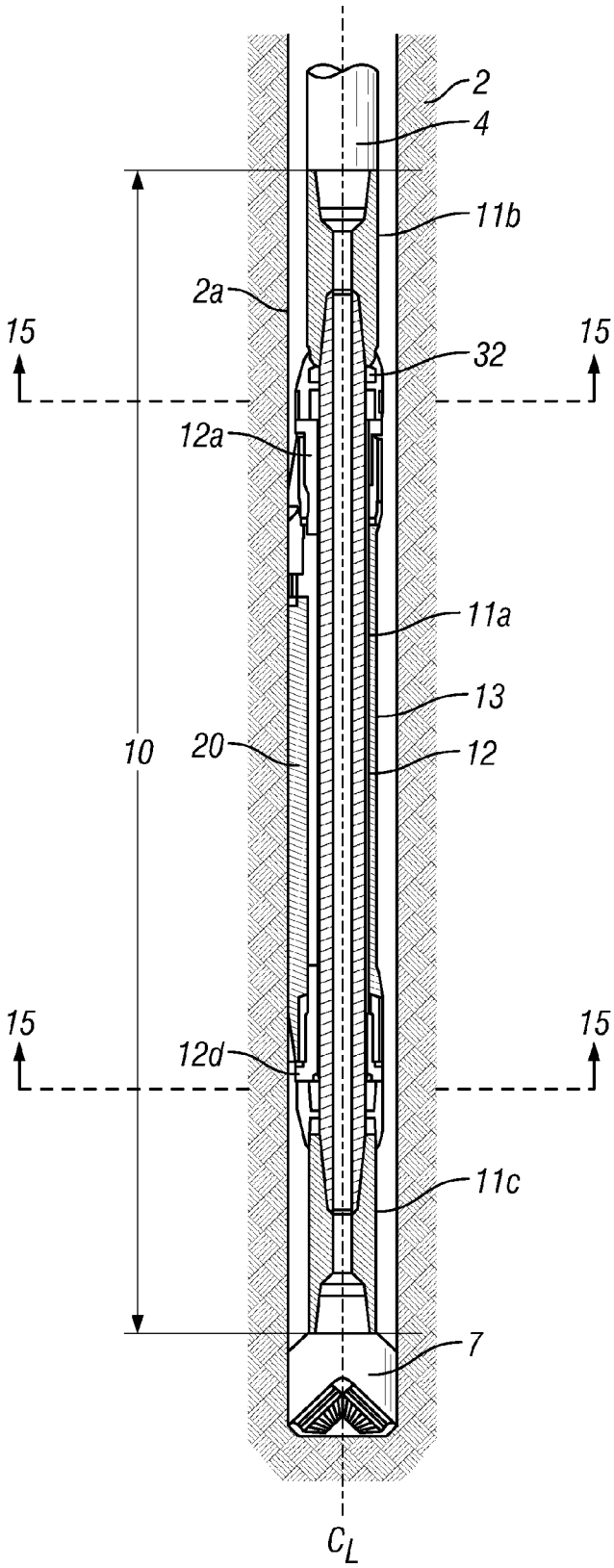
FIG. 1 is a cutaway side elevation view of a downhole tool in an inclined wellbore.

In the drawings and description that follows, lice parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring initially to FIGS. 1-4, there is shown a downhole tool 10 in the form of an RST tool for directional drilling shown in an inclined wellbore. FIG. 1 illustrates the low-side 2*a* of the wellbore 2, defined as the side of the wellbore nearest the center of the earth. The low-side 2*a* is on the left-hand side of the overall wellbore 2.

The downhole tool 10 is shown attached to an upper adapter sub 4, which would in turn be attached to a drill string (not shown). The adapter sub 4 is located at the upper end of the downhole tool 10, i.e. the end of the downhole tool 10 which is closest to the opening of wellbore 2. The adapter sub is attached to an inner rotatable mandrel 11. For the purposes of this description, the relative terms upper and lower are defined with respect to the wellbore 2, the upper end of the wellbore 2 being the open end, the lower end being the drilling face.

The adapter sub 4 serves to connect the drill string to the inner rotatable mandrel 11. However, the adapter sub 4 may not be necessary if the drill string pipe threads match the downhole tool 10 threads.

The mandrel 11 has an elongate central part 11*a* that extends almost the whole length of the tool 10. At either end, the central part of the mandrel 11*a* is connected to an upper mandrel section 11*b* and a lower mandrel section 11*c*. The upper part 11*b* of the mandrel 11 is attached to upper adapter sub 4. The lower part 11*c* of the mandrel 11 is attached directly to a drill bit 7. In practice a lower adapter sub may be located between the mandrel and drill bit 7 if the threads differ between the mandrel 11 and drill bit 7. The lower part 11*c* also need mot be connected directly to the drill bit 7, but may be connected to additional drill string or other downhole tools, such as a mud motor.

An inner sleeve 12 is located about at least a portion of the mandrel 11 and has an eccentric bore. The mandrel 11 is free to rotate within the inner sleeve 12. In practice, bearing surfaces may be present between the mandrel 11 and the inner sleeve 12 to allow rotation of the mandrel 11. The inner sleeve 12 of the example has two parts, an upper part 12*a* and a lower part 12*d*. In the downhole tool 10 of FIG. 1, both the upper part 12*a* and the lower part 12*d* have an eccentric bore for receiving the mandrel 11. The upper part 12*a* is located close to the top end of the downhole tool 10 and the lower part 12*d* is located towards the lower part of the downhole tool 10. The upper and lower parts of the inner sleeve 12 are spaced apart from one another along the length of the mandrel 11. However, it should be appreciated that inner sleeve 12 may be one part surrounding at least a portion of the length of the mandrel 11.

The downhole tool 10 also includes an outer housing 13. In the example of FIG. 1, the outer housing 13 houses the middle part 11*a* of the mandrel 11. The upper 12*a* and lower 12*d* pails of the inner sleeve are located at the upper and lower ends of the housing 13 respectively, such that the housing 13 only covers a portion of each of the upper and lower parts of the inner sleeve 12*a*, 12*d*. The inner sleeve 12 may be turned freely within an area, by a drive means (not shown), inside the outer housing. The outer housing 13 may be eccentric on its outside, resulting in a "heavier" side. This heavier side of the outer housing 13 is referred to as the "biasing portion" 20.

The biasing portion 20 of the outer housing 13 forms the heavy side of the outer housing 13 and may be manufactured as a part of the outer housing 13. The outer housing 13 is freely rotatable under gravity such that the biasing portion 20 will bias itself toward the low side of the wellbore 2. In operation, the position of the inner sleeve 12 is manipulated with respect to the position of the biasing portion 20 of the outer housing. Therefore, the inner sleeve 11 is moveable with respect to the outer housing 13.

Figure 2:
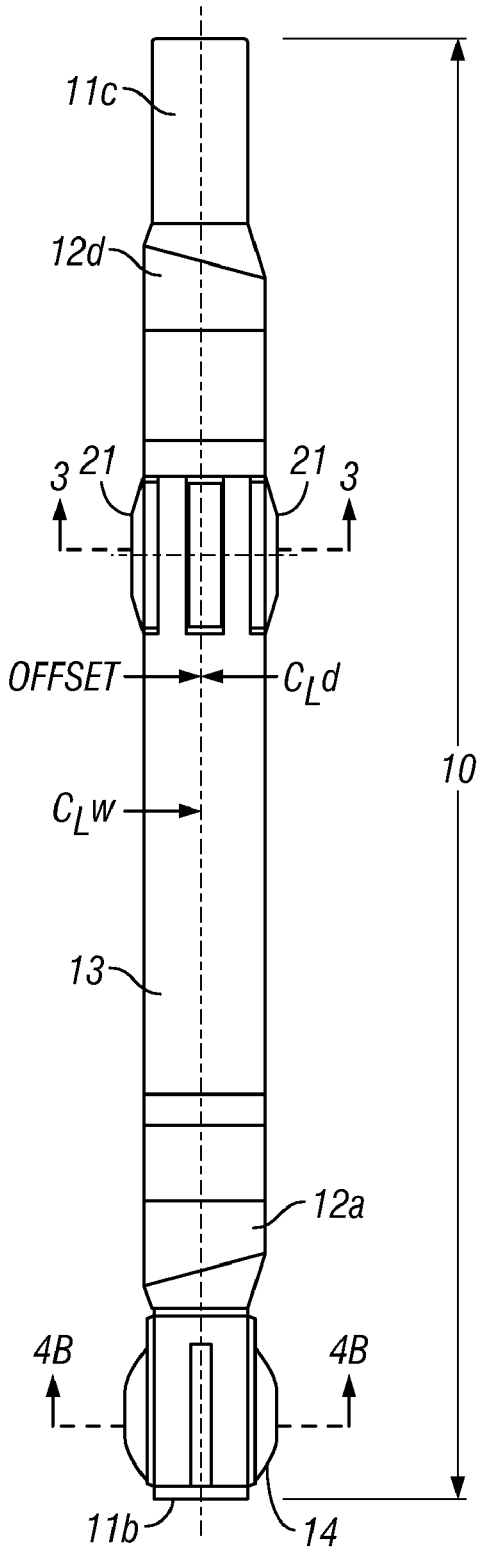
FIG. 2 is a side elevation view of the downhole tool of FIG. 1.

FIG. 2 is external view of the downhole tool 10 without the upper adapter sub 4 or drill bit 7. The upper and lower parts 11*b* and 11*c* of the mandrel are respectively located at the top and bottom of the downhole tool 10. Adjacent the upper and lower parts 11*b* and 11*c* of the mandrel 11 are located the upper and lower parts 12*a* and 12*d* of the inner sleeve 12. Viewed from the outside, the outer housing 13 is located between the upper 12*a* and lower 12*d* parts of the inner sleeve 12. As explained with reference to FIG. 1, the upper and lower parts of the inner sleeve 12 are partially located within the housing 13.

Stabilizer blades 21 are located on the outside of the outer housing 13. In this particular example, three stabilizer blades 21 are located around the circumference of the outer housing 13. The stabilizer blades 21 may be elongate and aligned parallel with the rotation axis of the downhole tool 10. The stabilizer blades 21 may also be positioned at 90 degree intervals from one another. As there are only three stabilizer blades shown in the example of FIG. 2, the stabilizer blades 21 do not extend around the entire circumference of the outer housing 13. The stabilizer blades 21 are arranged so that there is a first blade 180 degrees away from the biased portion 20, with two stabilizer blades 21 positioned on either side of the first stabilizer blade 21. The stabilizer blades 21 serve to counter any reactionary rotation on the part of the outer housing 13 caused by bearing friction between the rotating mandrel 11 and the inner sleeve 12 and to center the outer housing 13 within the borehole 2. Three secondary stabilizer blades 14 are located around the lower part 11*c* of mandrel 11. These stabilizer blades 14 may be arranged symmetrically around the circumference of the mandrel 11 with 120 degrees between each stabilizer blade 14.

FIG. 2 shows the principle axis of wellbore 2 as $C/L_W$ and the rotation axis of the bit (or drill string) as $C/L_D$. The rotation axis of the drill string and the principle axis of the wellbore 2 will not always be parallel to one another, as when the downhole tool 10 effects a change in the desired drilling direction. The rotation axis and the principle axis are offset by the eccentricity of the inner sleeve 12 in FIG. 2.

Figure 3:
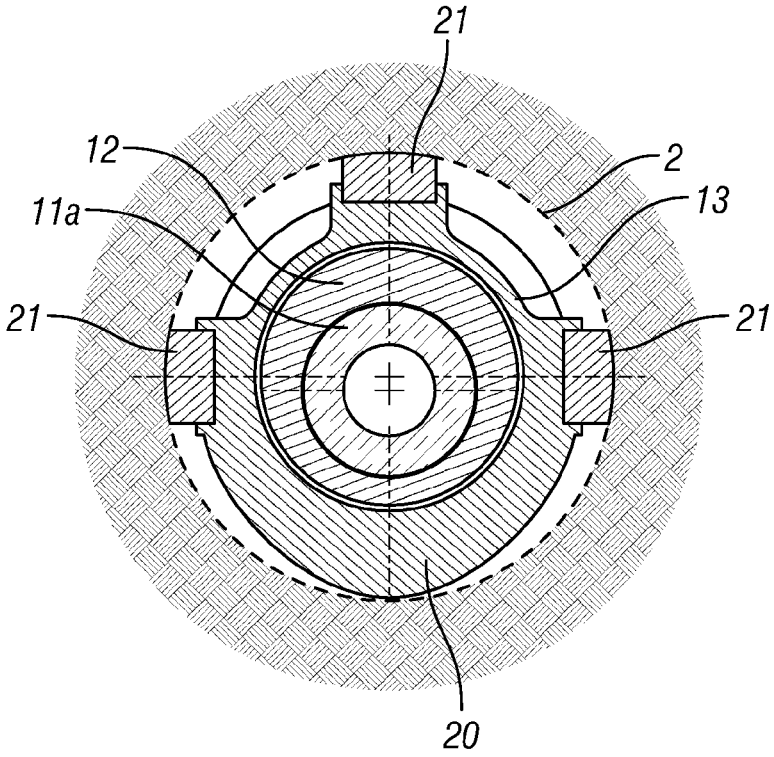
FIG. 3 is a cross section view of the downhole tool of FIGS. 1 and 2 taken at 3-3.

FIG. 3 shows a cross section of the downhole tool 10 through line 3-3 of FIG. 2. In FIG. 3, the biased portion 20 of the outer housing 13 locates itself at the low side of the wellbore 2. The stabilizer blades 21 located on the circumference of the outer housing 13 are arranged such that the middle stabilizer blade 21 is located against the high side of the wellbore 2 with the other two stabilizer blades 21 located on the right and left sides of the wellbore 2. The inner sleeve 12 is located within the bore of the outer housing 13. Previously, the inner sleeve 12 has been described in terms of two parts, an upper 12*a* and a lower part 12*d*. FIG. 3 just shows the upper part 12*a* of the inner sleeve 12 shown in the example of FIG. 1. However, it will be appreciated by those skilled in the art that the lower part 12*d* of the sleeve 12 could also be used in this cross section. The inner sleeve 12 is eccentrically bored. The mandrel 11, or more correctly, the central part of the mandrel 11*a* is located within the bore of the inner sleeve 12. The inner sleeve 12 can be rotated with respect to the biased portion 20 of the outer housing 13 thus changing the force on the mandrel 11.

Figure 4:
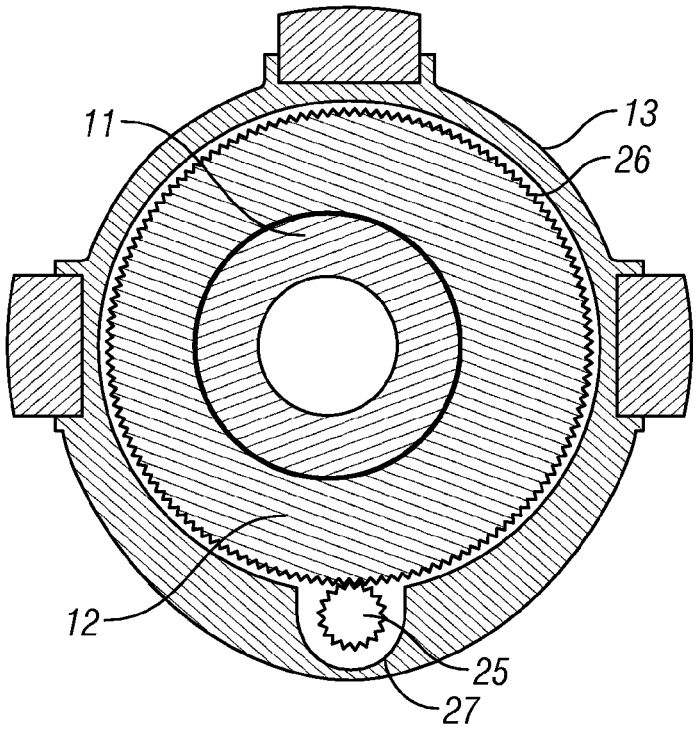
FIG. 4 illustrates a drive coupled to the inner sleeve of the downhole tool powered by a motor.

In FIG. 4, the actuator, which may be an electric or hydraulic motor or other means, is located within a cavity 27 within the biased portion 20 of the outer housing 13. Within this cavity is also located a pinion gear 25 associated with the actuator. The teeth on the pinion gear 25 are capable of interengaging with the teeth on the ring gear 26 such that movement of the pinion 25 effects movement of the inner sleeve 12 with respect to the outer housing 13. The power supply may be provided by a battery that is also located within the biased portion 20 or, the rotation of the mandrel 11 may be used to rotate the pinion 25.

Because the teeth of the ring gear 26 and the pinion 25 interact, the inner sleeve 12 and the outer housing 13 are locked in position with respect to one another once the pinion 25 becomes stationary. The RST tool 10 may further include a "brake" to lock the position of the inner sleeve 12 relative to the outer housing 13 once the desired relative position is obtained.

In order to change the drilling direction, the actuator must be actuated and told by how much to move the inner sleeve 12. Such information may be signaled from an electronics system 40 that includes a processor either included in the downhole tool 10 itself or located on the surface but in communication with the downhole tool 10 through any suitable telemetry means, such a telemetry system that is part of a bottom-hole-assembly that in turn communicates with the surface. Further, as discussed below, the downhole tool 10 includes a method of signaling the surface to confirm the position of the inner sleeve 12 relative to the outer housing 13.

The actuator in the outer housing 13 may move the inner sleeve 12 using a drive train including the ring gear 26 and the pinion 25 having a 10,000:1 gear ratio. Thus, it takes 10,000 revolutions of the actuator/pinion 25 to rotate the ring gear 26/inner sleeve 12 one complete rotation.

Figure 5A:
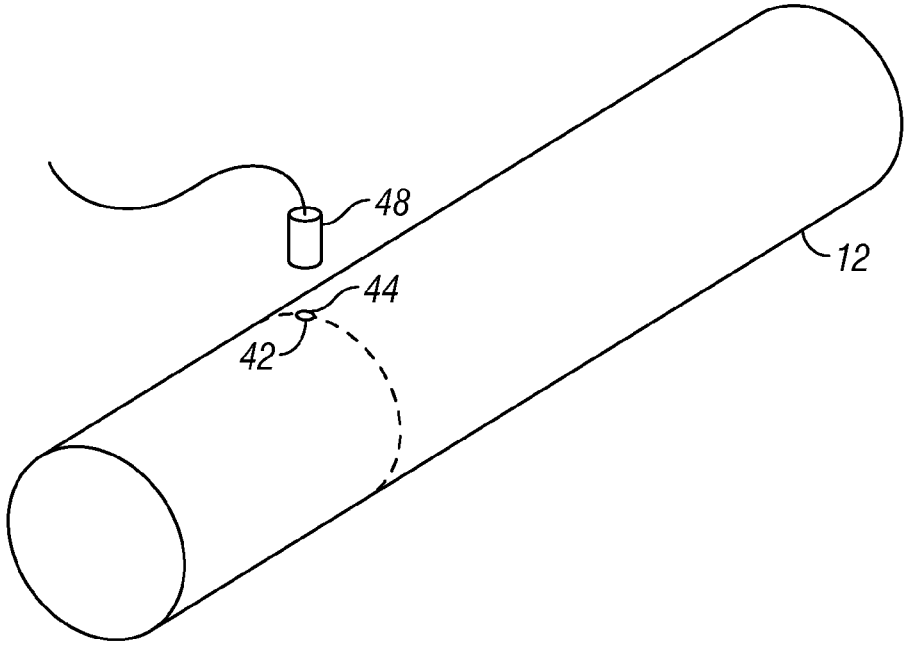
FIG. 5A is a simplified perspective view of the inner sleeve of the downhole tool of FIG. 1.

Referring now to FIGS. 5A-9, the RST tool 10 operation thus uses the known orientation of the outer housing 13 and the relative orientation of the inner sleeve 12 to the outer housing 13 to control the drilling direction. To verify the relative orientation of the inner sleeve 12 to the outer housing 13, the RST tool 10 uses a magnetic position sensing system. As illustrated in FIGS. 5A and 5B, the magnetic position sensing system includes more than one selected positions 42 spaced around the outer surface of the inner sleeve 12 and organized in at least one "set". Each set includes at least one selected position 42 placed about a given plane of the inner sleeve 12. Each of the selected positions 42 includes either a magnet with a North pole orientation 44, a magnet with a South pole orientation 46, or no magnet at all. At least two of the selected positions 42 include either North or South pole magnets 44, 46, whether they be in one set or more than one set. The magnetic flux of each of the North and South pole magnets 44, 46 is sufficient to overcome the Earth's ambient magnetic field.

The magnetic position sensing system also includes at least one magnetic sensor 48 for each corresponding set of selected positions 42. The magnetic sensor 48 is capable of sensing at least one of the amplitude and polarity of the magnetic field for the selected positions 42. For example, the magnetic sensor(s) 48 may be a linear, bipolar Hall Effect sensors. As a further example, more than one magnetic sensor 48 may be used where the magnetic sensors 48 are all non-bipolar, all bipolar, or a combination of bipolar and non-bipolar sensors. The magnetic sensor(s) 48 may be located in the outer housing 13 and may be situated in a stainless steel or other magnetically transparent pressure vessel such that the magnetic sensor(s) 48 is(are) isolated from the borehole pressure. As such, there will be material between the magnetic sensor(s) 48 and the North and South pole magnets 44, 46 located on the inner sleeve 12. This intervening material should, as far as possible, be magnetically transparent. In other words, the magnetic field should pass through this material without becoming deflected or distorted. Materials that exhibit these properties include austenitic stainless steels and other non-ferrous material.

Figure 8:
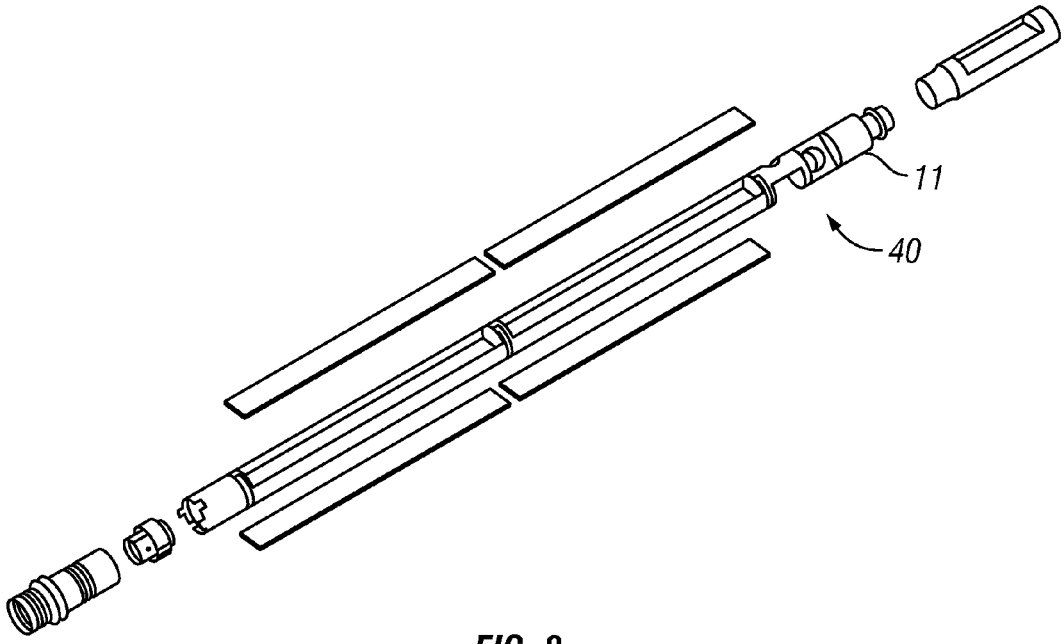
FIG. 8 is an exploded perspective view of an example electronics system for use with the downhole tools of FIGS. 1-7.
Figure 8A:
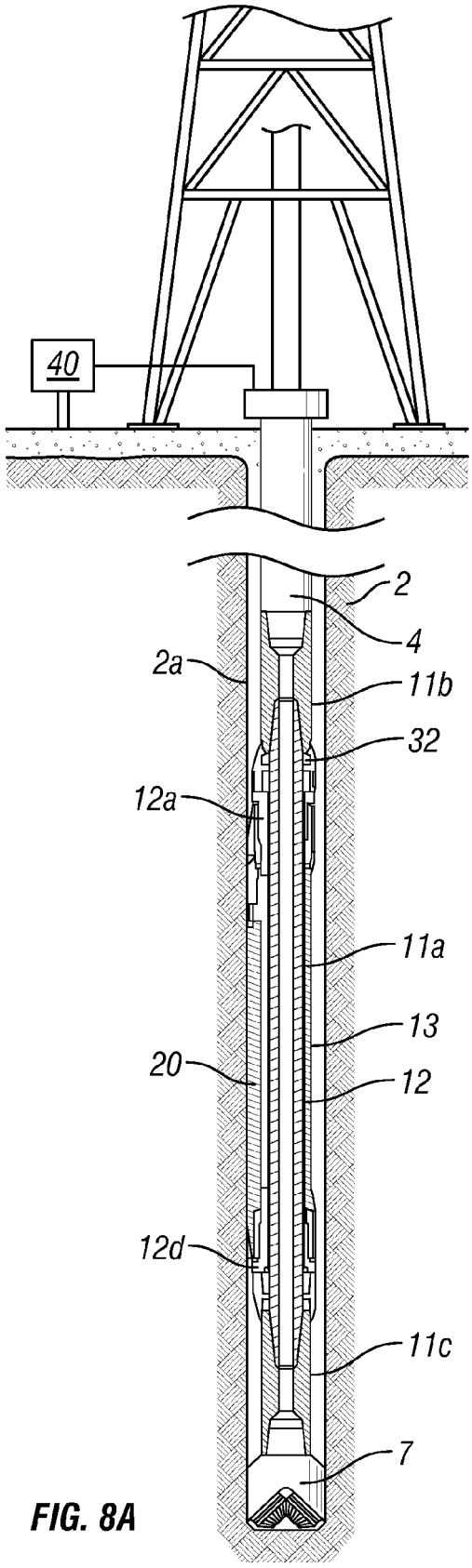
FIG. 8A is an elevation view of an example surface electronics system for use with the downhole tools of FIGS. 1-7.

As illustrated in FIG. 8, the magnetic sensor(s) 48 is/are in communication with the electronics system 40 and transmit a signal indicative of the sensed magnetic field. As illustrated, the electronics system 40 is located in the downhole tool 10 itself. As mentioned previously, however, the electronics system 40 may also be located on the surface and be in communication with the downhole tool 10 through any suitable telemetry system as illustrated in FIG. 8A.

Figure 6:
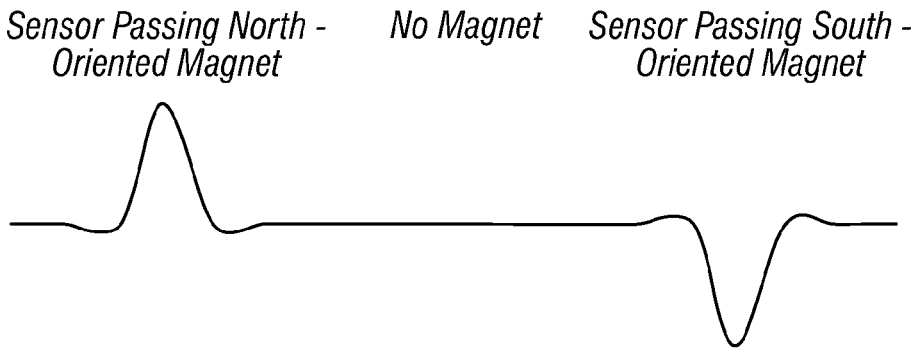
FIG. 6 is an example output signal of a linear magnetic sensor for use with the downhole tool of FIG. 1.

As illustrated in FIG. 6, the downhole tool 10 includes an electronics system 40 for processing the sensor signal to determine a "magnet" reference position of the inner sleeve relative to the outer housing. As the inner sleeve 12 rotates relative to the outer housing 13, the North and South pole magnets 44, 46 pass by the magnetic sensor(s) 48. Each magnetic sensor 48 then produces a signal corresponding to at least one of the amplitude and orientation of the sensed magnetic field. If the magnetic sensor 48 is bipolar, as a North pole magnet 44 passes by the magnetic sensor 48, the magnetic sensor 48 signal amplitude increases in the North pole direction and then returns to baseline, which is indicative of the naturally occurring magnetic field without the affect of a North or South pole magnet 44, 46. As a South pole magnetic field is sensed by a passing South pole magnet 46, the amplitude of the signal increases in the South pole direction and then returns to baseline. If the magnetic sensor 48 only senses the amplitude of the magnetic field, then the signal will still increase with an increase in magnetic flux, but will only increase in one direction, not indicating polarity. With the location of the selected positions 42 known, the electronics system 40 then processes this signal to determine the position of the inner sleeve 12 relative to the outer housing 13 as the inner sleeve 12 rotates with respect to the outer housing 13. The selected positions 42 may be uniformly or non-uniformly spaced about the inner sleeve 12. The magnetic signal thus presents a coding for an operating logic that the electronics system 40 uses to process the signal and determine the position of the inner sleeve 12 relative to the outer housing 13. For example, the selected positions may be spaced 180 degrees apart in the example of FIG. 5A and include a North pole magnet 44 at one selected position 42 and a South pole magnet 46 at the other selected position 42. For such an example, the following coding would result:

TABLE 1

Sensor/Magnet Coding from FIG. 5A

| Toolface | Magnet Sensor | Output Voltage |
|---|---|---|
| 0 | +1 | 1.50 |
| 180 degrees | −1 | 3.50 |

As shown, there are only two positions because only two positions may actually be sensed. A "null" selected position 42 (where there is no magnet) will produce the same magnetic signal as when sensing a non-selected position with no magnet and so may not be used to give a positive indication of position.

Figure 5B:
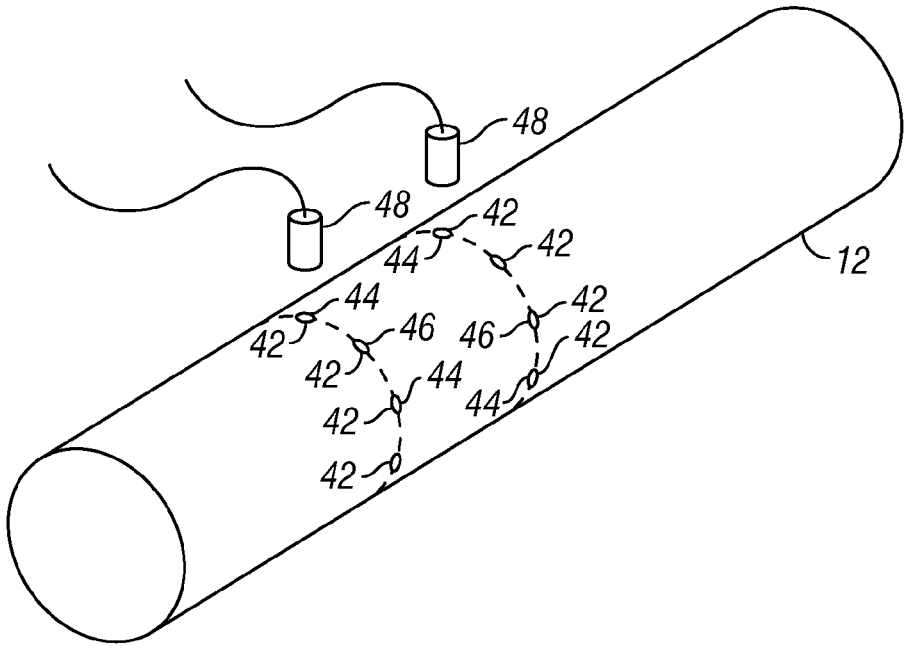
FIG. 5B is a simplified perspective view of an alternative inner sleeve of the downhole tool of FIG. 1.
Figure 7:
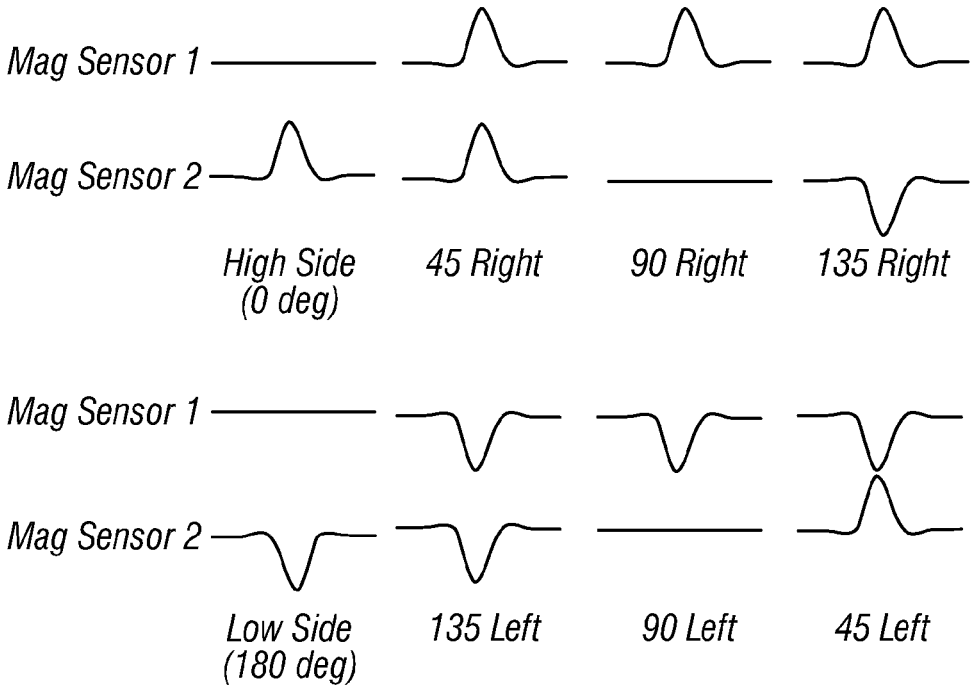
FIG. 7 are example output combinations for dual linear magnetic sensors for use in the downhole tool of FIG. 5B.

As discussed and as illustrated in FIG. 5B, the downhole tool 10 may also include more than one set of selected positions 42 on the outer surface of the inner sleeve 12. Again, each selected position may include either a North pole oriented magnet 44, a South pole oriented magnet 46, or no magnet. In the example shown in FIG. 5B, for each set of selected positions, there is a corresponding bipolar magnetic sensor 48 capable of sensing the amplitude and polarity of the magnetic field for the selected positions 42. The electronics system 40 processes the signals from the magnetic sensors 48 according to the possible signal combinations from the sensors 48 as illustrated in FIG. 7. Or, in tabular form, the resulting coding is as follows:

TABLE 2

| | Sensor/Magnet Combinations | | |
|---|---|---|---|
| Toolface | Magnet Sensor 1 | Magnet Sensor 2 | Output Voltage |
| 0 | 0 | +1 | 0.50 |
| 45 Right | +1 | +1 | 1.00 |
| 90 Right | +1 | 0 | 1.50 |
| 135 Right | +1 | −1 | 2.00 |
| 180 | 0 | −1 | 2.50 |
| 135 Left | −1 | −1 | 3.00 |
| 90 Left | −1 | 0 | 3.50 |
| 45 L | −1 | +1 | 4.00 |

As illustrated, the selected positions 42 are uniformly spaced. However, it should be appreciated that the selected positions 42 may also not be uniformly spaced. As can be shown from Tables 1 and 2, because there are only three possibilities for the magnet orientations (North, South, or no magnet), the total number of selected positions detectable for a given sensor/magnet configuration is the number of sensor states to the power of the number of sensors, minus one. Thus, for the example shown in FIG. 5B, there are two bipolar sensors 48, each having three sensor states so the total number of possible selected positions is three squared minus one, or eight as shown in Table 2.

Figure 9:
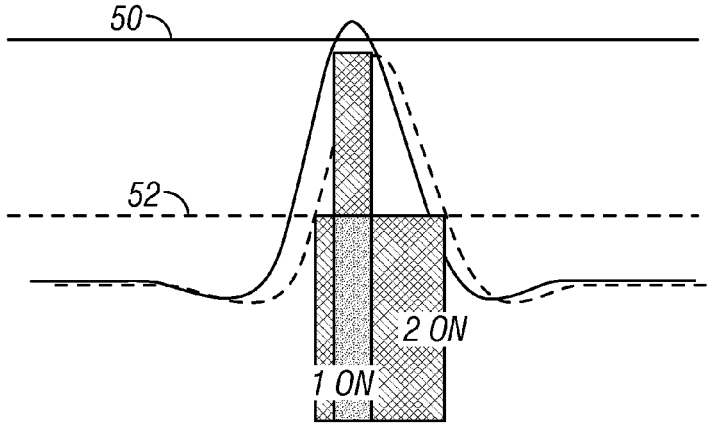
FIG. 9 is an example linear signal output graph for two magnetic sensors illustrating signal threshold processing.

As illustrated in FIG. 9, sensor signal thresholds may also be set that negate the effect of the Earth's magnetic field and that serve as limit switches. These limit switches may be employed as a means of logic control within the electronics system 40. For example, if the magnetic sensors 48 are not exactly aligned, or the selected positions of each set of selected positions are not exactly aligned, the magnetic sensors (48) may prematurely signal a North pole/no magnet combination, when in fact, the inner sleeve 12 is only a small degree of rotation away from a North pole/North pole combination. Therefore, the electronics system 40 only processes the sensor signals if the amplitude of at least one signal is greater than a first selected threshold 50, or trigger threshold. Once at least one signal rises above the first selected threshold 50, the electronics system 40 then processes that signal and drops the signal threshold for all the magnetic sensor signals to a second selected threshold 52, where the second selected threshold is lower than the first selected threshold 50. Likewise, the electronics system 40 must also determine when to return to the decreased processing mode. Thus, once the electronics system 40 determines that any magnetic signal drops below the second selected threshold, the electronics system 40 stops processing all of the signals from the magnetic sensors 48. The electronics system 40 then raises the threshold back up to the first selected threshold 50 for triggering the processing the next time a magnetic signal rises above the trigger threshold 50.

Alternatively, the magnetic position sensing system illustrated in FIGS. 1-9 may also be used in cooperation with a motor reference position sensing system as previously discussed. As discussed the motor is used to move the inner sleeve 12 relative to the outer housing 13. The motor energizes reference poles as the motor rotates relative to the reference poles, the energization of a reference pole transmitting a signal, or "click". The electronics system 40 may also be capable of processing the "clicks" from the energization of the reference poles for determining a "motor" reference position of the inner sleeve 12 relative to the outer housing 13. The electronics system 40 may also be capable of comparing the "motor" reference position of the inner sleeve 12 relative to the outer housing 13 with the "magnet" reference position determined from the processing of the signals from the magnetic sensors 48. As previously discussed, the "motor" reference system, while possibly being more precise, has the potential to have the "motor" reference position to be out of sync with the actual relative position of the inner sleeve 12 relative to the outer housing 13. If the "magnet" reference position differs front the "motor" reference position by more than a selected amount, the electronics system 40 may then "reset" the "motor" reference position to be that of the "magnet" reference position. The "motor" reference position system may then continue to monitor the position of the inner sleeve 12 relative to the outer housing 13 as previously described. This combination provides redundancy to the determination of the position of the inner sleeve 12 relative to the outer housing in case of failure of one of the measuring systems. The combination also provides the potentially more accurate position determination of the "motor" reference system with the reliability of the "magnet" reference system.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A downhole tool including:

a mandrel;

an inner sleeve to surround at least a portion of the mandrel, the mandrel being rotatable relative to the inner sleeve;

an outer housing to surround at least a portion of the inner sleeve, the mandrel and inner sleeve being rotatable relative to the outer housing;

the outer circumference of the inner sleeve including more than one selected position organized into more than one set arranged in spaced-apart radial planes of the inner sleeve;

at least two of the selected positions including magnets;

a magnetic sensor corresponding to each set to sense at least one of the amplitude and polarity of the magnetic field for the selected positions and to transmit a signal indicative of the sensed magnetic field; and an electronics system to process the sensor signal to determine a magnet reference position of the inner sleeve relative to the outer housing.

2. The downhole tool of claim 1 wherein the electronics system is located in the downhole tool.

3. The downhole tool of claim 1 wherein the electronics system is located on the surface.

4. The downhole tool of claim 1 further including:

at least one set including a North pole magnet and a South pole magnet; and at least one bipolar magnetic sensor to sense the amplitude and polarity of the magnetic fields of the North and South pole magnets.

5. The downhole tool of claim 4 wherein the total number of selected positions is one less than the number of sensor states to the power of the number of sensors.

6. The downhole tool of claim 4 wherein each set includes a North pole magnet and a South pole magnet all of the magnetic sensors are bipolar sensors.

7. The downhole tool of claim 4 wherein:

the magnetic sensors being linear sensors; and wherein the electronics system only processes the sensor signals if the amplitude of at least one signal is greater than a first selected threshold and no signal is below a second selected threshold, the second selected threshold being less than the first selected threshold.

8. The downhole tool of claim 1 further including:

a motor to rotate the inner sleeve relative to the outer housing, the motor energizing reference poles as the motor rotates relative to the reference poles, the energization of a reference pole transmitting a signal;

the electronics system to process the signals from energization of the reference poles to determine a motor reference position of the inner sleeve relative to the outer housing;

the electronics system to compare the motor reference position of the inner sleeve relative to the outer housing with the magnet reference position of the inner sleeve relative to the outer housing;

the electronics system to reset the motor reference position of the inner sleeve relative to the outer housing with the magnet reference position of the inner sleeve relative to the outer housing if the motor reference position of the inner sleeve relative to the outer housing differs by more than a selected amount.

9. A method of sensing the position of a downhole tool including:

providing a mandrel;

surrounding at least a portion of the mandrel with an inner sleeve, the mandrel being rotatable relative to the inner sleeve and the outer circumference of the inner sleeve including more than one selected position organized in more than one set arranged in spaced-apart radial planes of the inner sleeve;

surrounding at least a portion of the inner sleeve with an outer housing, the mandrel and inner sleeve being rotatable relative to the outer housing;

placing magnets in at least two of the selected positions;

sensing at least one of the amplitude and polarity of the magnetic field for the selected positions with a magnetic sensor corresponding to each set;

transmitting a signal indicative of the sensed magnetic field to an electronics system; and processing the sensor signal to determine a magnet reference position of the inner sleeve relative to the outer housing.

10. The method of claim 9 wherein the electronics system is located in the downhole tool.

11. The method of claim 9 wherein the electronics system is located on the surface.

12. The method of claim 9 further including:

placing a North pole magnet and a South pole magnet in at least one set; and sensing the amplitude and polarity of the magnetic fields of the North and South pole magnets with at least one bipolar magnetic sensor.

13. The method of claim 12 wherein the total number of selected positions is one less than the number of sensor states to the power of the number of sensors.

14. The method of claim 12 further including placing a North pole magnet and a South pole magnet in each set and wherein all of the magnetic sensors are bipolar sensors.

15. The method of claim 12 wherein:

the magnetic sensors being linear sensors; and only processing the sensor signals if the amplitude of at least one signal is greater than a first selected threshold and no signal is below a second selected threshold, the second selected threshold being less than the first selected threshold.

16. The method of claim 9 further including:

including a motor to rotate the inner sleeve relative to the outer housing;

energizing reference poles as the motor rotates relative to the reference poles, the energization of a reference pole transmitting a signal;

processing the signals from energization of the reference poles to determine a motor reference position of the inner sleeve relative to the outer housing;

comparing the motor reference position of the inner sleeve relative to the outer housing with the magnet reference position of the inner sleeve relative to the outer housing;

resetting the motor reference position of the inner sleeve relative to the outer housing with the magnet reference position of the inner sleeve relative to the outer housing if the motor reference position of the inner sleeve relative to the outer housing differs by more than a selected amount.

17. A drilling system including:

a drill string;

a drill bit associated with the drill string; and a downhole tool on the drill string including:

a mandrel;

an inner sleeve to surround at least a portion of the mandrel, the mandrel being rotatable relative to the inner sleeve;

an outer housing to surround at least a portion of the inner sleeve, the mandrel and inner sleeve being rotatable relative to the outer housing;

the outer circumference of the inner sleeve including more than one selected position organized into more than one set arranged in spaced-apart radial planes of the inner sleeve;

at least two of the selected positions including magnets;

a magnetic sensor corresponding to each set to sense at least one of the amplitude and polarity of the magnetic field for the selected positions and to transmit a signal indicative of the sensed magnetic field; and an electronics system to process the sensor signal to determine a magnet reference position of the inner sleeve relative to the outer housing.

18. The drilling system of claim 17 wherein the electronics system is located in the downhole tool.

19. The drilling system of claim 17 wherein the electronics system is located on the surface.

20. The drilling system of claim 17 further including:

at least one set including a North pole magnet and a South pole magnet; and at least one bipolar magnetic sensor to sense the amplitude and polarity of the magnetic fields of the North and South pole magnets.

21. The downhole tool of claim 20 wherein the total number of selected positions is one less than the number of sensor states to the power of the number of sensors.

22. The downhole tool of claim 20 wherein each set includes a North pole magnet and a South pole magnet all of the magnetic sensors are bipolar sensors.

23. The downhole tool of claim 20 wherein:

the magnetic sensors being linear sensors; and wherein the electronics system only processes the sensor signals if the amplitude of at least one signal is greater than a first selected threshold and no signal is below a second selected threshold, the second selected threshold being less than the first selected threshold.

24. The downhole tool of claim 17 further including:

a motor to rotate the inner sleeve relative to the outer housing, the motor energizing reference poles as the motor rotates relative to the reference poles, the energization of a reference pole transmitting a signal;

the electronics system to process the signals from energization of the reference poles to determine a motor reference position of the inner sleeve relative to the outer housing;

the electronics system to compare the motor reference position of the inner sleeve relative to the outer housing with the magnet reference position of the inner sleeve relative to the outer housing;

the electronics system to reset the motor reference position of the inner sleeve relative to the outer housing with the magnet reference position of the inner sleeve relative to the outer housing if the motor reference position of the inner sleeve relative to the outer housing differs by more than a selected amount.

* * * * *